United States Patent [19]

Benuzzi

[11] 4,174,745

[45] Nov. 20, 1979

[54] DEVICE FOR MAKING A GROOVE IN THE EDGE OF A PANEL

[76] Inventor: Gino Benuzzi, 5, Via Angelo Custode, Bologna, Italy, 40100

[21] Appl. No.: 834,351

[22] Filed: Sep. 19, 1977

[30] Foreign Application Priority Data

Sep. 20, 1976 [IT] Italy ..... 12796 A/76
May 13, 1977 [IT] Italy ..... 12604 A/77

[51] Int. Cl.[2] ..... B27C 9/00

[52] U.S. Cl. ..... 144/1 R; 144/3 R; 144/136 R; 144/326 R

[58] Field of Search ..... 144/1 R, 2 R, 3 R, 41, 144/134 R, 136 R, 323, 326 R; 90/18

[56] References Cited

U.S. PATENT DOCUMENTS 3,251,388 5/1966 Ennis ..... 144/3 R
3,421,556 1/1969 Clifford ..... 144/3 R
3,837,384 9/1974 Sybertz ..... 144/136 R
4,058,150 11/1977 Pennington ..... 144/1 R

*Primary Examiner*—Robert Louis Spruill
*Assistant Examiner*—W. D. Bray
*Attorney, Agent, or Firm*—Pollock, Vande Sande & Priddy

[57] ABSTRACT

The device for making a groove in the edge of a panel or a stack of panels consists of a grooving saw supported by a structure which is movable from a rest position above the panel and remote from the edge to be grooved, to a starting position below the panel, to a subsequent working stroke directed upwardly, during which the groove is made, and again to the rest position. In order to exactly follow the contour of the edge, which may be rounded, the grooving saw is guided in its working stroke by a feeler roller which feels the outer contour of the edge.

3 Claims, 8 Drawing Figures

DEVICE FOR MAKING A GROOVE IN THE EDGE OF A PANEL

SUMMARY OF THE INVENTION

The present invention relates to sawing machines for cutting panels and stacks of panels of material such as wood, particleboard, hardboard, plywood or the like, which are veneered or laminated with plastic on one or both sides and along the edges. The sawing machine according to the invention is of the type in which the panels are supported on a horizontal supporting table and a main circular saw effects the cutting in a vertical plane, moving across the said supporting table along a horizontal cutting line.

In this type of sawing machines there exists the problem that the main saw, upon entering or coming out of the panels, tends to push outwardly with its teeth the material being cut in correspondence of the edges of the panel, thus giving rise to the breaking off of splinters and to imperfections in the kerf edges, particularly in the case of fully laminated panels, i.e., panels veneered or plastic-covered on both sides and also along the edges.

According to the invention, in a sawing machine of the type above mentioned, there is provided a device for making a groove or incision in the edge of the panels, so that the main cutting saw, when operating in correspondence of the grooved edge, encounters a precut groove which avoids the said splintering upon the entrance or exit of the main saw into, respectively out of the panel.

Preferably, the device for making the groove comprises a grooving saw arranged in a vertical plane in alignment with the cutting plane of the circular saw, and means for moving said grooving saw in the said vertical plane against and along the edge to be grooved, to effect its working stroke, and for withdrawing the grooving saw, after it has made the groove, to a rest position remote from said edge and above the panel or panel stack, so that it does not interfere with the action of the main cutting saw.

Other objects and advantages of the device according to the invention will appear evident from the following specification made with reference to the attached drawings.

DESCRIPTION OF THE PREFERRED EMBODIMENT

Figures 1, 2, 3, 4, 5:
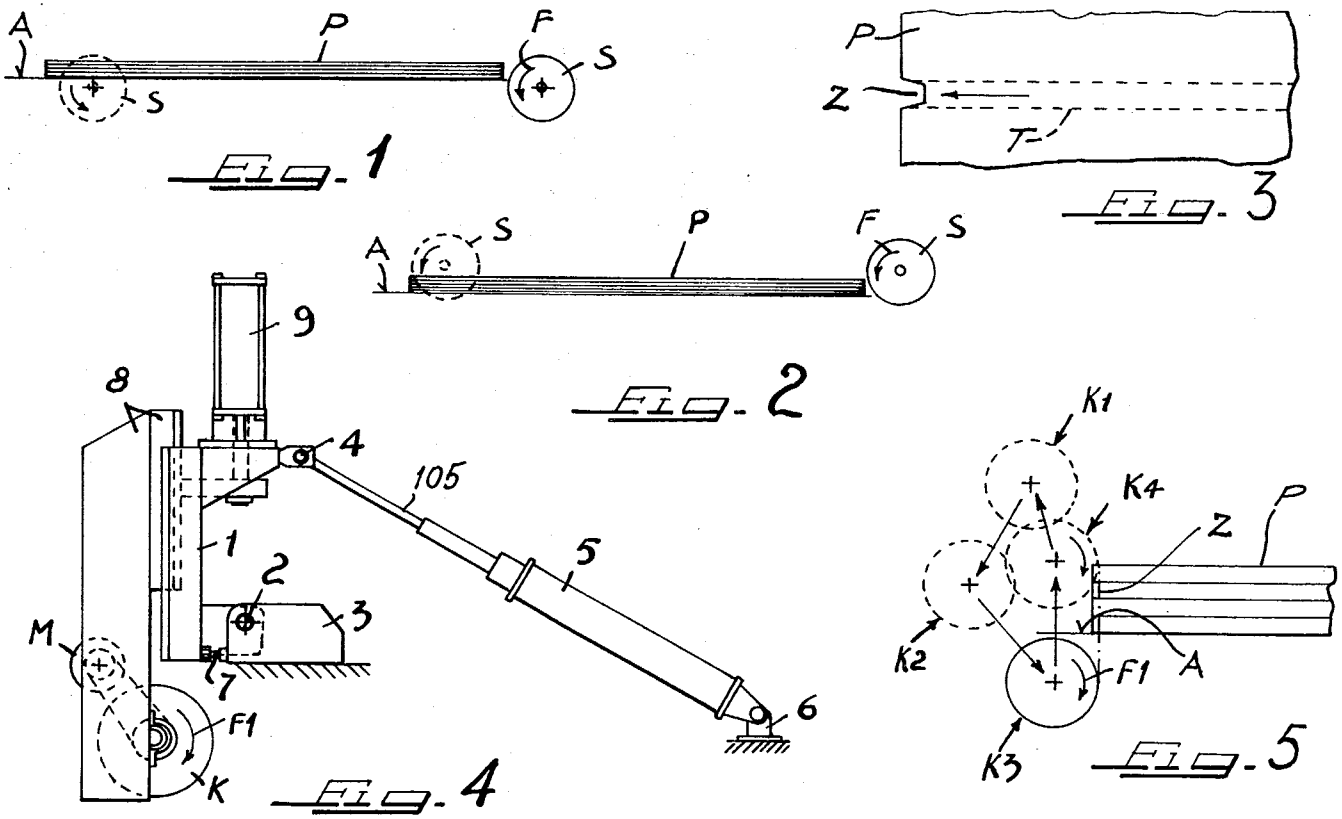
FIGS. 1 and 2 diagrammatically show two possible methods of executing the cuts with sawing machines of the type mentioned.
FIG. 3 is a fragmentary top view showing the groove made by the device according to the invention on the edge of a panel or stack of panels.
FIG. 4 is a side elevation view showing a first embodiment of the grooving device according to the invention.
FIG. 5 is a side elevation view showing the working cycle of the grooving device according to FIG. 4.

With reference to FIG. 1, a package or stack of panels P, lying on a supporting table A, is subjected to the cutting action of the main circular saw S, rotating in counter-clockwise direction F, and moving horizontally from the right hand side of the Figure to the left hand side, where, by dash-and-dot lines there is indicated the same saw S shortly before coming out of the stack P of panels. In front of the circular saw, relative to the direction of cut, there is provided a scoring tool (not shown) which scores the lower surface layer of the stack P of panels. A circular saw of this type is illustrated, for example, in British Pat. No. 1,232,800, in the name of the present inventor. The entry of the saw S into the stack P does not present any problem, since, due to the direction of rotation of the saw S, the teeth of the saw act by pressing against the right edge of the stack P and against the upper surface of the stack itself. However, when the saw S exists from the left side of the stack S, its teeth intend to push outwardly from the interior in toward the edge of the stack, causing splintering and imperfections in the kerf edges, particularly in the case of fully laminated workpieces, such as sheets of wood or the like veneered or plastic covered on both surfaces and along the edges.

As shown in FIG. 1, the circular cutting saw S has its axis located below the stack P of panels. A similar situation arises when the cutting of the stack P of panels is effected by means of a circular saw S having its axis located above the stack P of panels, as shown in FIG. 2, with the difference that the splintering may be produced at the right or entry edge of the stack P of panels.

In order to eliminate the problem, the invention provides for a grooving tool, in the form of a grooving saw, which, by moving vertically along the edge of the stack of panels, cuts a vertical groove Z (see FIG. 3) which is perfectly perpendicular and centered with respect to the cutting line T of the saw S. The said groove Z preferably is shaped in such a manner as to result, at least with respect to the outer surface of the edge of the stack of panels, in a width which is greater than the width of the cutting line T of the saw S, so that, in existing from the stack of panels, the saw S does not encounter the outer surface of the edge of the stack of panels.

With reference to FIGS. 4 and 5, a first embodiment of the vertically acting grooving device according to the invention will now be described.

The device is arranged either on the left hand side or on the right hand side of the stack of panels, depending whether it is fitted on a panel cutting machine having the axis of the cutting saw S located below (FIG. 1) or above (FIG. 2) the stack of panels. The device comprises (see FIG. 4) a rectilinear guide 1 fulcrumed at its lower end at 2 to a fixed support member 3. The rectilinear guide 1 is hinged at its upper end at 4 to the stem 105 of a fluid pressure operated cylinder unit 5 which is fulcrumed to a fixed support member 6. The piston cylinder unit 5 has the function of bringing the guide from a perfect vertical position, determined by the adjustable abutment member 7, to an inclined position.

On guide 1 there is mounted a slide 8 which can be actuated by a piston cylinder unit 9. At the lower end of the slide 8 there is mounted the grooving saw K, which is rotatably driven, in the direction of the arrow F1, by the motor M.

The operation of the described device is the following: While the slide 8 is brought in its uppermost or lifted position, the retraction of the stem 105 is caused so that the grooving saw passes from the position indicated in FIG. 5 by reference letter K4 to the position K1. Cylinder 9 is then actuated so as to bring the grooving saw from position K1 to K2. At this stage, cylinder 5 is actuated so as to return the slide 8 to its vertical position, and the grooving saw thus reaches the position indicated by reference letter K3, below the stack P of panels.

At this point, the grooving saw is set into rotation, and in the meantime the slide 8 is lifted under the action of the piston cylinder unit 9, so that the grooving saw passes from position K3 to position K4 and cuts the groove Z on the edge of the stack P of panels. The grooving saw is then brought into the position K1 in order to permit the operation of the cutting saw S.

Figure 6:
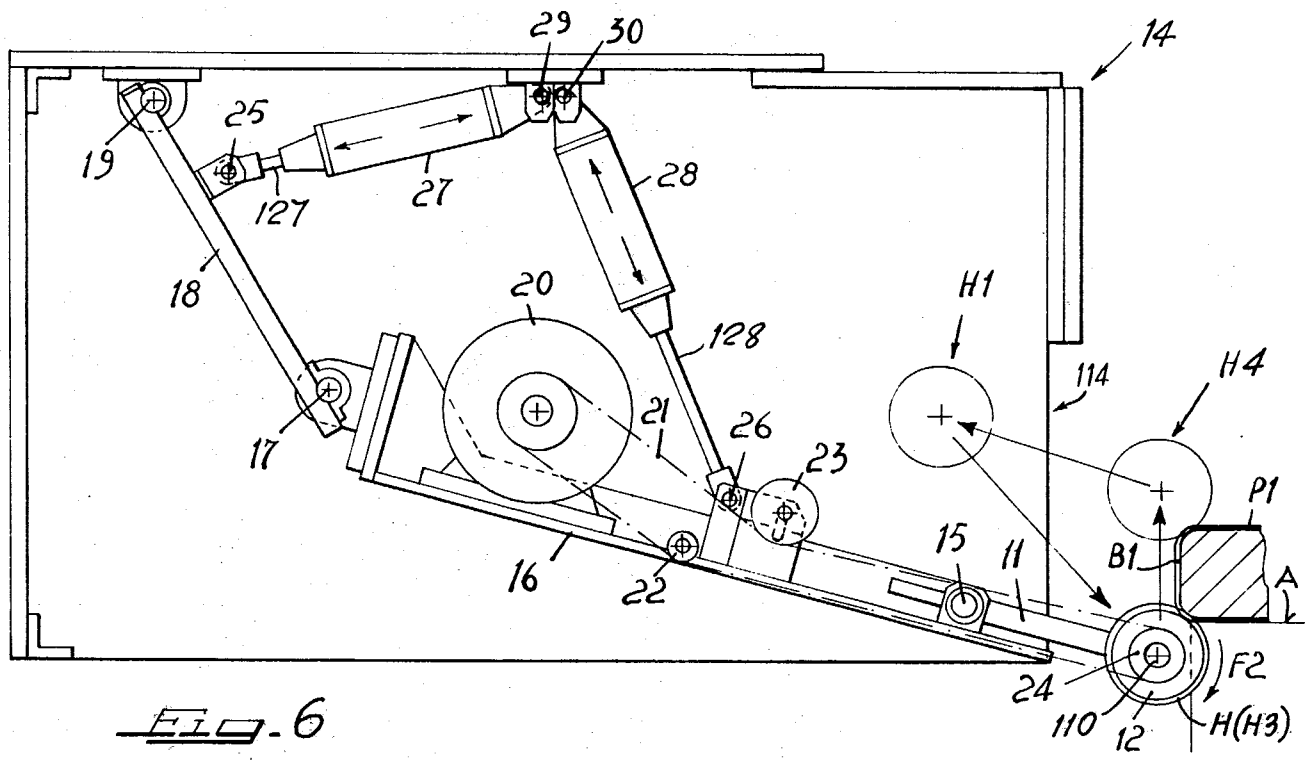
FIG. 6 is a side elevation view showing a second embodiment of the grooving device.
Figure 7:
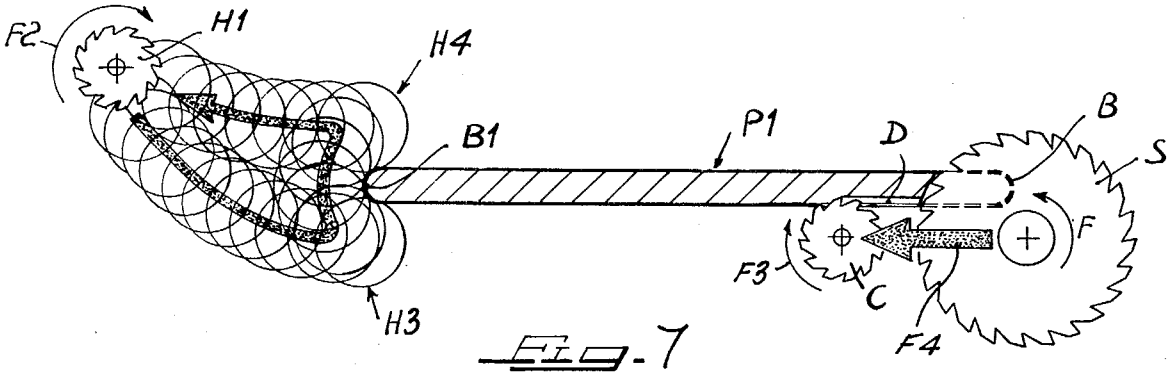
FIG. 7 is a diagrammatical side view showing the working cycle of the grooving device according to FIG. 6.
Figure 8:
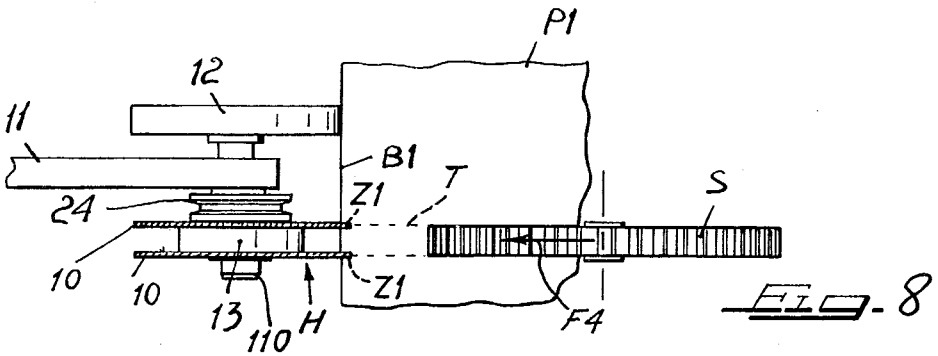
FIG. 8 is a fragmentary detail, viewed from the top, of the grooving device according to FIG. 6.

FIGS. 6 to 8 illustrate another embodiment of a grooving device according to the invention, particularly adapted for the grooving of the edges of panels P1 (see FIG. 7) presenting rounded edges B and B1 completely veneered or covered by plastic material. Reference letter S indicates the circular cutting saw which rotates in the direction of arrow F and is preceded, relative to the direction of cut F4, by a scoring saw C which rotates in the direction of arrow F3, and effects the groove or score D on the lower surface of the panel P1.

In order to obtain a grooving of the rounded edge B1 of the panel P1, the grooving tool H (see FIG. 8) which consists of a pair of coaxial thin saws 10, is mounted on a shaft 110 which is carried by the supporting arm 11 and is driven into rotation through pulley 24. On the same shaft 110 of the grooving tool H there is mounted a feeler roller 12, which abuts against the outer surface of the rounded edge B1 of the panel P1, and guides the grooving tool H in proper movement so as to effect, by means of its two parallel saws 10, spaced from each other by interposed changeable spacer element 13, a pair of cuts Z1 extending inside the panel for a predetermined length (corresponding to the difference between the diameter of the saws 10 and of the feeler roller 12) all around the rounded edge B1. It is to be noted that advantageously the two saws 10 may be interspaced so as to effect two cuts Z1 on the panel edge B1 at a distance which is slightly larger than the width of the cut T effected by the saw S. Of course, a single grooving saw, as indicated in the embodiments of FIGS. 1 to 5, may be used.

Referring particularly to FIG. 6, the grooving device is housed in a casing 14 which is partially open at least at 114 adjacent to the edge of the panel P1. The supporting arm 11 of the grooving tool H is adjustably mounted at 15 on the supporting plate 16 which is articulated at 17 to an arm 18 articulated on its turn at 19 to the top wall of the casing 14. On the supporting plate 16 there is mounted the electric motor 20 which through belt 21 and tensioning and guide pulleys 22, 23 drives the pulley 24 keyed on the shaft of the grooving tool H. In intermediate points of the plate 16 and of the arm 18 there are respectively hinged, at 26 and 25, the stems 128 and 127 of cylinder piston units 28, respectively 27, which are in their turn fulcrumed at 30, respectively 29, to the top wall of casing 14.

Through suitable automatic or semi-automatic controls of any known type, acting on the piston cylinder units 27 and 28, the grooving tool H, which rotates in the direction of arrow F2, is moved from an initial in operative position H1 (see particularly FIG. 7) to a starting position H3 from which it goes all around the rounded edge B1 of the panel P1 cutting the required groove (or parallel cuts Z1) and reaches the end of work position H4, from which position it is lifted and brought back to the inoperative position H1.

I claim:

1. In a sawing machine for cutting panels and the like, of the type in which said panels are supported on a horizontal supporting table and a main circular saw effects the cutting in a vertical plane and moves across said supporting table along a horizontal cutting line, a device for making at least one groove or incision in the edge of said panels at the line of entry or of exit of said circular saw into or respectively out of said panels, comprising (a) a grooving saw arranged in a vertical plane in alignment with said cutting plane of said main circular saw;

(b) means for moving said grooving saw in said vertical plane against and along said edge to effect its working stroke, and for withdrawing said grooving saw to a rest position remote from said edge, above or below said panel; and (c) feeler means for guiding said grooving saw in its working stroke, said feeler means comprising a feeler roller which follows the contour of the edge of said panel and guides said grooving saw along a path corresponding to said contour.

2. In a sawing machine for cutting panels and the like, of the type in which said panels are supported on a horizontal supporting table and a main circular saw effects the cutting in a vertical plane and moves across said supporting table along a horizontal cutting line, a device for making at least one groove or incision in the edge of said panels at the line of entry or of exit of said circular saw into or respectively out of said panels, comprising (a) a grooving saw arranged in a vertical plane in alignment with said cutting plane of said main circular saw, said grooving saw comprising two thin circular saws co-axially mounted and spaced a distance such that the distance between their outer side surfaces is slightly greater than the width of the cut effected by said main circular saw along said cutting line; and (b) means for moving said grooving saw in said vertical plane against and along said edge to effect its working stroke, and for withdrawing said grooving saw to a rest position remote from said edge, above or below said panel.

3. In a sawing machine for cutting panels and the like, of the type in which said panels are supported on a horizontal supporting table and a main circular saw effects the cutting in a vertical plane and moves across said supporting table along a horizontal cutting line, a device for making at least one groove or incision in the edge of said panels at the line of entry or of exit of said circular saw into or respectively out of said panel comprising (a) a grooving saw arranged in a vertical plane in alignment with said cutting plane of said main circular saw, said grooving saw being mounted on a supporting plate which is hingedly connected to an intermediate arm hingedly mounted on a fixed support, and including means for causing the swinging of said support plate with respect to said intermediate arm and the swinging of said intermediate arm with respect to said fixed support; and (b) means for moving said grooving saw in said vertical plane against and along said edge to effect its working stroke, and for withdrawing said grooving saw to a rest position remote from said edge, above or below said panel.

* * * * *